US005083652A

United States Patent [19]

Kobayashi et al.

[11] Patent Number: 5,083,652

[45] Date of Patent: Jan. 28, 1992

[54] CLASSIFICATION ACCURACY SETTING DEVICE FOR A COIN SELECTOR

[75] Inventors: Osamu Kobayashi, Tsurugashima; Yonezo Furuya, Hatoyama; Genzo Yoshizawa, Tokyo, all of Japan

[73] Assignee: Kabushiki Kaisha Nippon Conlux, Tokyo, Japan

[21] Appl. No.: 388,460

[22] Filed: Aug. 2, 1989

[30] Foreign Application Priority Data

Aug. 11, 1988 [JP] Japan ..... 63-200760

[51] Int. Cl.[5] ..... G07D 5/08

[52] U.S. Cl. ..... 194/318; 453/3

[58] Field of Search ..... 194/317, 318, 319; 209/569, 570; 453/3

[56] References Cited

U.S. PATENT DOCUMENTS 4,749,074 6/1988 Ueki et al. ..... 194/317

FOREIGN PATENT DOCUMENTS

85/04037 9/1985 World Int. Prop. O. ..... 194/317

*Primary Examiner*—F. J. Bartuska

*Attorney, Agent, or Firm*—Diller, Ramik & Wight

[57] ABSTRACT

A classification accuracy setting device and a method therefor of a coin selector used in an automatic vending machine, a money exchanger and other various automatic service apparatuses. In accordance with the operation of the device, a reed switch is turned on to set a classification accuracy selection mode, the number of coins of each denomination received in this mode is counted, and reference values of classification accuracies which have been stored in a memory are rewritten in response to the counted number.

7 Claims, 6 Drawing Sheets

CLASSIFICATION ACCURACY SETTING DEVICE FOR A COIN SELECTOR

BACKGROUND OF THE INVENTION

1. Field of the Invention

This invention relates to a classification accuracy setting device and a method therefor of a coin selector used in an automatic vending machine, a money exchanger and other various automatic service apparatuses.

2. Description of the Related Art

The coin selector has two types, mechanical type and electronic type. The mechanical type mechanically checks the property of a coin and classifies the coin according to its denomination, and the electronic type electronically detects the property of a coin and classifies the coin according to its denomination on the basis of the resulting detection output. The use of the electronic type coin selector has been more common because the electronic type coin selector has a higher classification accuracy and a smaller size.

One example of the electronic type coin selector has a coil provided at one side of a coin passageway and energized in response to a signal of a predetermined frequency, compares a frequency shift or an attenuated voltage waveform caused by the coil when a coin passes past the coil with a reference value corresponding to a predetermined classification accuracy in order to determine whether the received coin is true or false and the kind of the received coin, and classifies the coin on the basis of the result of the determination.

Another example of the electronic type coin selector has an oscillating coil which is provided at one side of a coin passageway and energized in response to a signal of a predermined frequency, and a receiving coil which is provided at the other side of the coin passageway and electromagnetically coupled with the energized oscillating coil, compares an attenuated voltage waveform caused by the receiving coil when a coin passes between the oscillating and receving coils with a reference value corresponding to a predetermined classification accuracy in order to determine whether the received coin is true or false and the kind of the received coin, and classifies the coin on the basis of the result of the determination.

These electronic type coin selectors can select the reference values so as to moderate and make strict determination criteria for determining whether the received coin is true or false and the kind of the coin.

The conventional coin selector is so arranged that the reference values of the classification accuracies are set by varying a value of each of variable resistors at the time of assembling.

However, with this arrangement, there has been a problem that the classification accuracies cannot easily be changed by a routeman or a supervisor of a vending machine when he desires to slightly moderate or make strict the classification accuracies in order to eliminate false coins, since it is difficult to adjust the values of the variable resistors for determining desired levels of the classification accuracies.

An object of the present invention is to provide a classification accuracy setting device and a method therefor of a coin selector of which the classification accuracy can be easily changed.

SUMMARY OF THE INVENTION

In order to achieve this object, a device of the present invention comprises: a mode changeover means for setting a classification accuracy selection mode; memory means for storing reference values of classification accuracies corresponding to denominations of coins; money-denominationally processing means for counting the number of coins of each denomination received in the classification accuracy selection mode; and control means for rewriting the reference values for each of the denominations stored in the memory means in response to the number counted by the money-denominationally processing means.

For example, when a classification accuracy of 10-yen coin is changed, the operation of the classification accuracy setting device is changed over to a classification accuracy selection mode and then k 10-yen coins are dropped. Thereby, the reference value defining the classification accuracy of 10-yen coin is rewritten into a value corresponding to the number of the k 10-yen coins. Subsequently, a new reference value serves to classify 10-yen coins.

The present invention provides an advantage to easily cope with mischieves in a market because the classification accuracies of various received coins are changed over into a plurality of grades. In addition, the number of the received coins serves to easily change over the classification accuracies of the received coins.

DESCRIPTION OF THE PREFERRED EMBODIMENTS

The preferred embodiment of the present invention will be described hereinafter with reference to the drawings.

Figure 1:
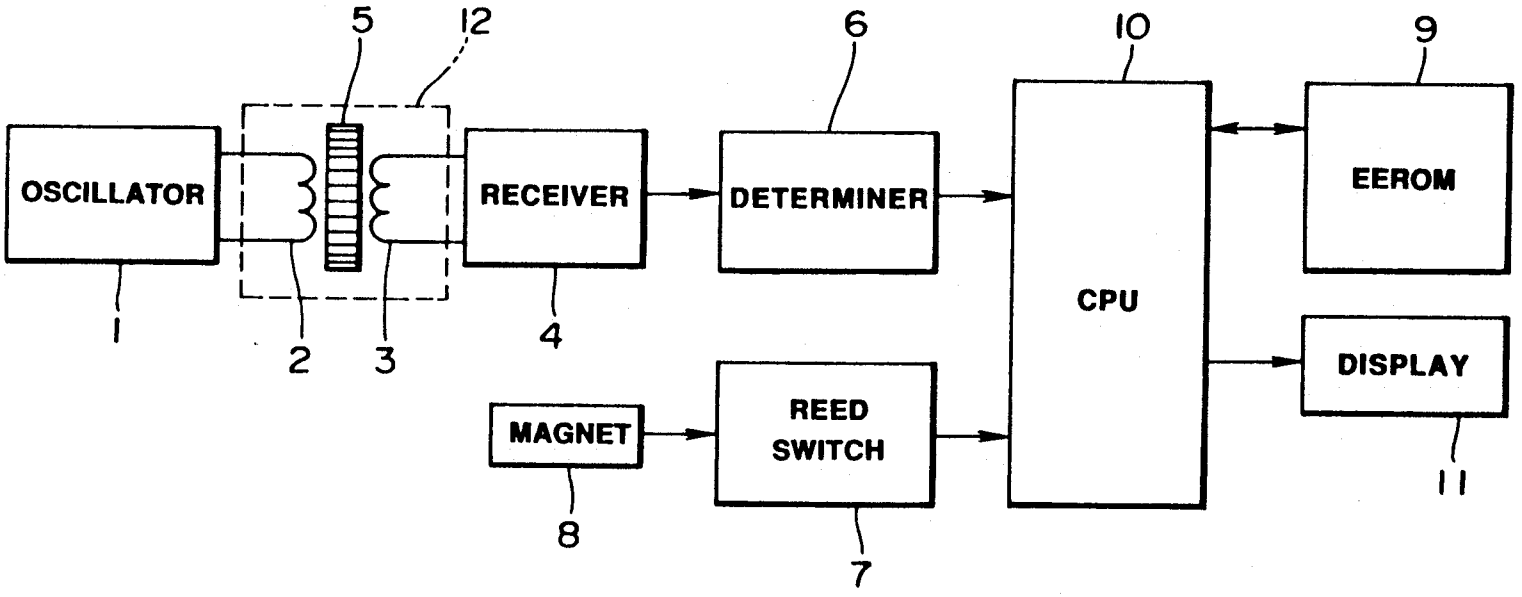
FIG. 1 is a block diagram illustrating one embodiment of the present invention.

FIG. 1 is a block diagram illustrating a coin selector according to one embodiment of the present invention. As shown in FIG. 1, an exciting coil 2 is disposed at one side of a coin passageway and excited by an oscillator 1. A receiving coil 3 which is electromagnetically coupled with the exciting coil 2 is disposed at the other side of the coin passageway. Dropping a coin 5 produces a voltage signal in the receiving coil 3 which is in turn received by a receiver 4. A determiner 6 compares the voltage signal received by the receiver 4 with reference values for each of the denominations for classifying coins. A reed switch 7 serves to change over a mode and produces a mode changeover signal showing that the operation of an apparatus has been changed over into a classification accuracy selection mode, when the reed switch 7 detects a magnet 8. An electrically erasable read-only memory or EEROM 9 stores n-rated reference values of the classification accuracies corresponding to each of the denominations.

A central processing unit or CPU 10 classifies the received coins 5, counts the number of the coins 5 of each denomination received in the classification accuracy selection mode and rewrites the reference value of each denomination stored in the memory 9 in accordance with the number of the received coins of each denomination. A display 11 displays a selected classification accuracy etc.

Figure 2:
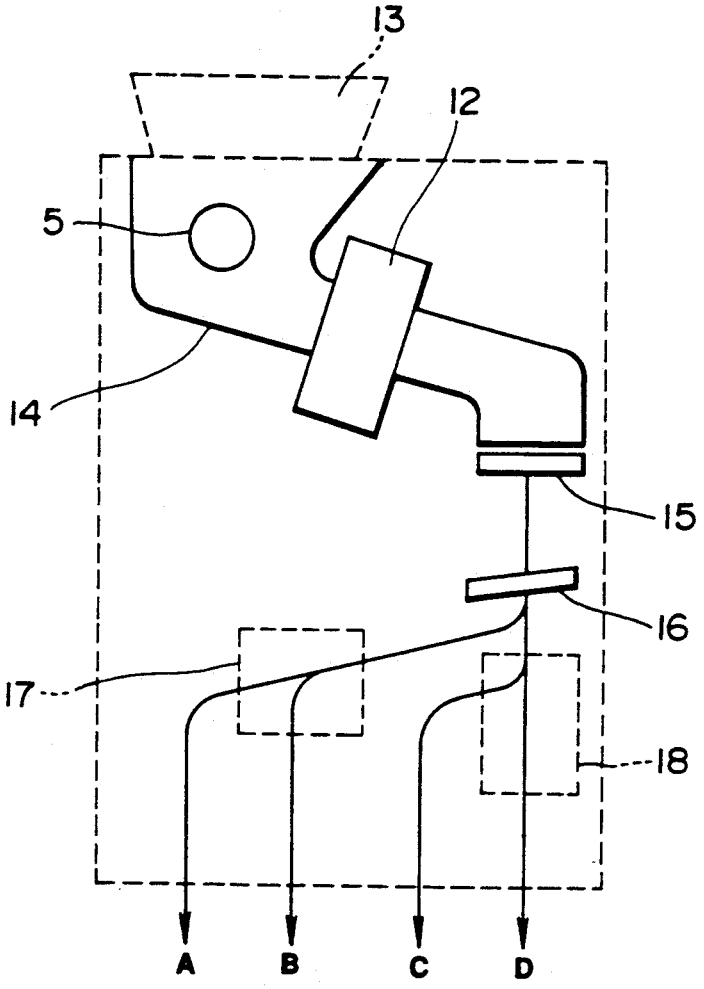
FIG. 2 is a diagram of a coin passage system.

The exciting coil 2 and the receiving coil 3 together form a coin identification sensor 12 producing a voltage signal in response to the property of the received coin 5. As shown by the diagram of the coin passage system of FIG. 2, the coin identification sensor 12 is provided intermediate a coin passageway 14 situated nearest to a slot 13.

The determiner 6 determines the voltage signal produced by the coin identification sensor 12 and corresponding to the property of each of the received coins 5. If the received coins 5 are true coins, a first movable element 15 disposed at the downstream of the coin identification sensor 12 opens an inlet of a true coin passageway and guides the coins into the true coin passageway. A second movable element 16 classifies the true coins guided into the true coin passageway into a first group including coins A and B and a second group including coins C and D. In addition, a first passageway selector 17 classifies the coins of the first group into the coins A and B and a second passageway selector 18 classifies the coins of the second group into the coins C and D. If the received coins 5 are false coins, the first movable element 15 will not operate, so that the false coins are guided into a false coin passageway.

Figure 3A:
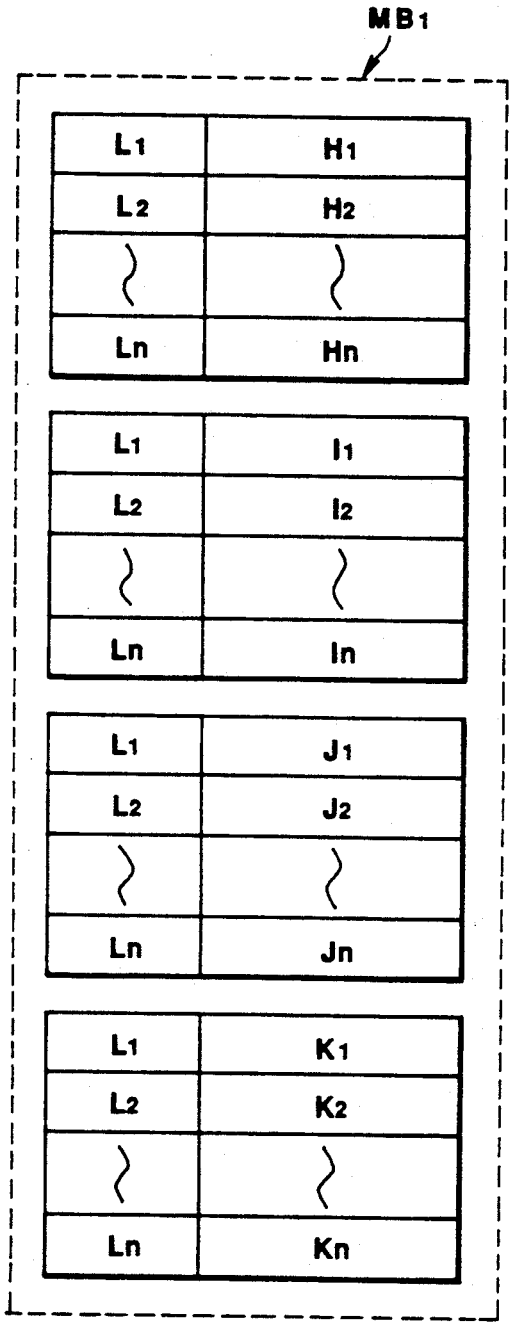
FIGS. 3(*a*) and 3(*b*) illustrate arrangements of memories storing reference values of classification accuracies.
Figure 3B:
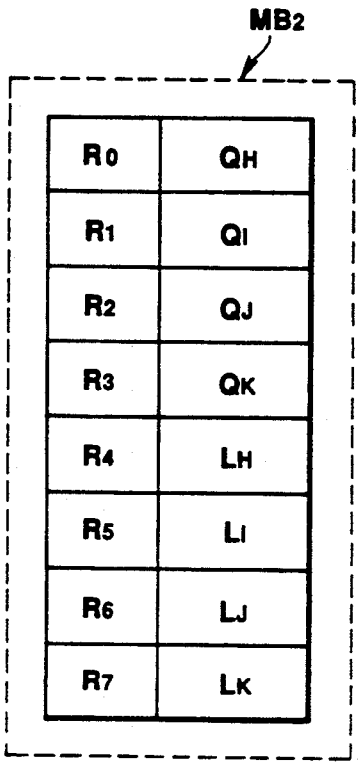

As shown in FIGS. 3( *a* ) and 3( *b* ), the memory 9 comprises memory blocks MB1 and MB2. The memory block MB1 stores respectively n-rated reference values of the classification accuracies Hl to Hn, Il to In, Jl to Jn and Kl to Kn corresponding to each of the denominations. In this embodiment, the letters Hl to Hn represent the reference values for 10-yen coin, the letters Il to In represent the reference values for 50-yen coin, the letters Jl to Jn represent the reference values for 100-yen coin, and the letters Kl to Kn represent the reference values for 500-yen coin.

On the other hand, the memory block MB2 includes R0 to R7 register areas. The R0 to R3 register areas store numbers QH, QI, QJ and QK of the received coins of each of the 10-yen to 500-yen denominations in the classification accuracy selection mode, and the R4 to R7 register areas store indexes LH, LI, LJ and LK indicating which of the n-rated reference values is applied. For example, when the index LH=1, the reference value Hl of which condition is loosest to classify 10-yen coins is applied.

In addition, each of the reference values Hl to Hn, Il to In, Jl to Jn, and Kl to Kn has a first value as an upper limit and a second value as a lower limit so as to serve to determine whether or not the above voltage signal falls between the first and second values in order to identify a coin. For example, when the reference value Hl loosest in conditions is applied, the range between the first and second values is broadest.

Figure 4:
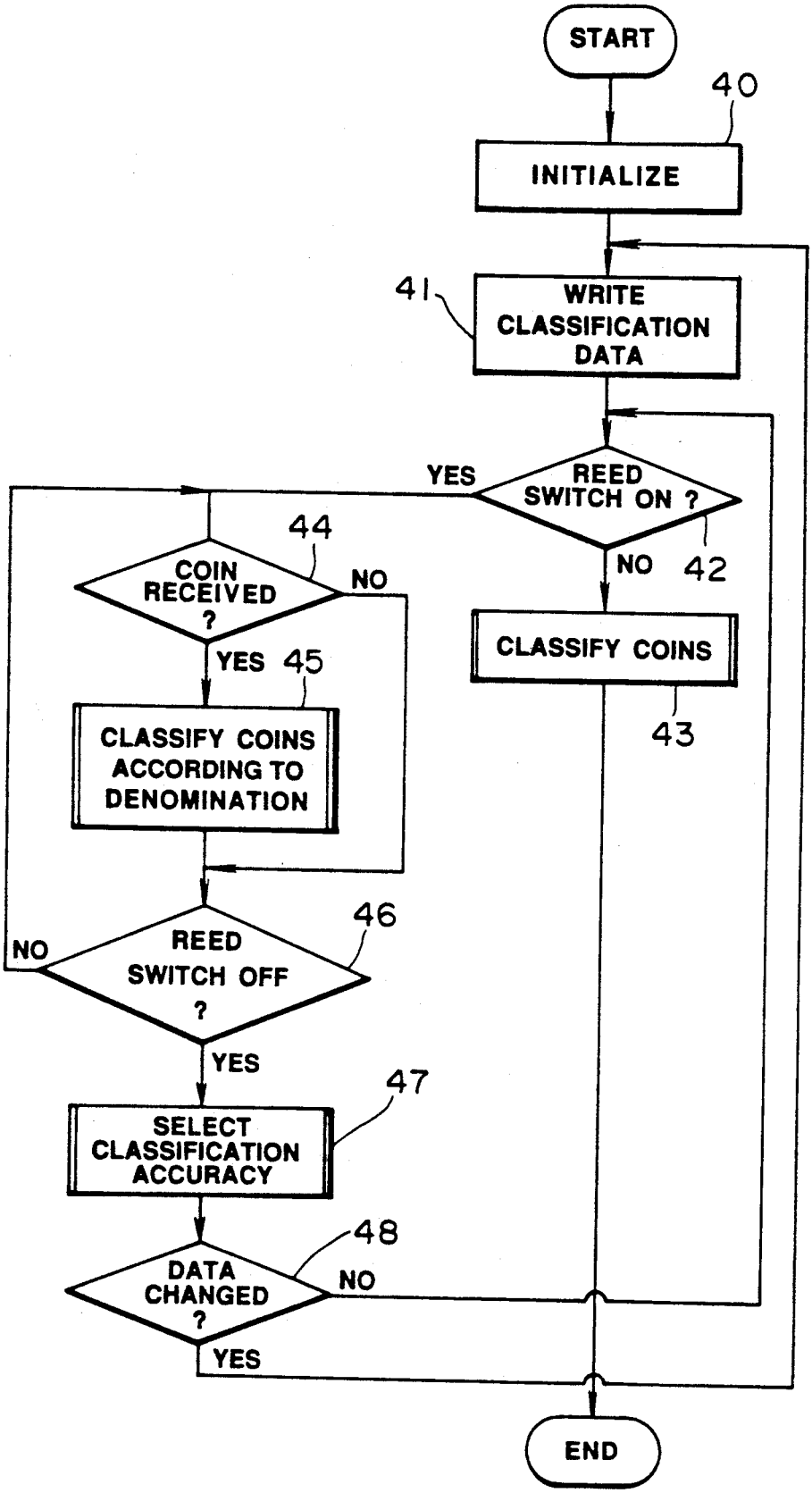
FIG. 4 is a flowchart of a main procedure of classifying coins and setting corresponding classification accuracies.
Figure 5:
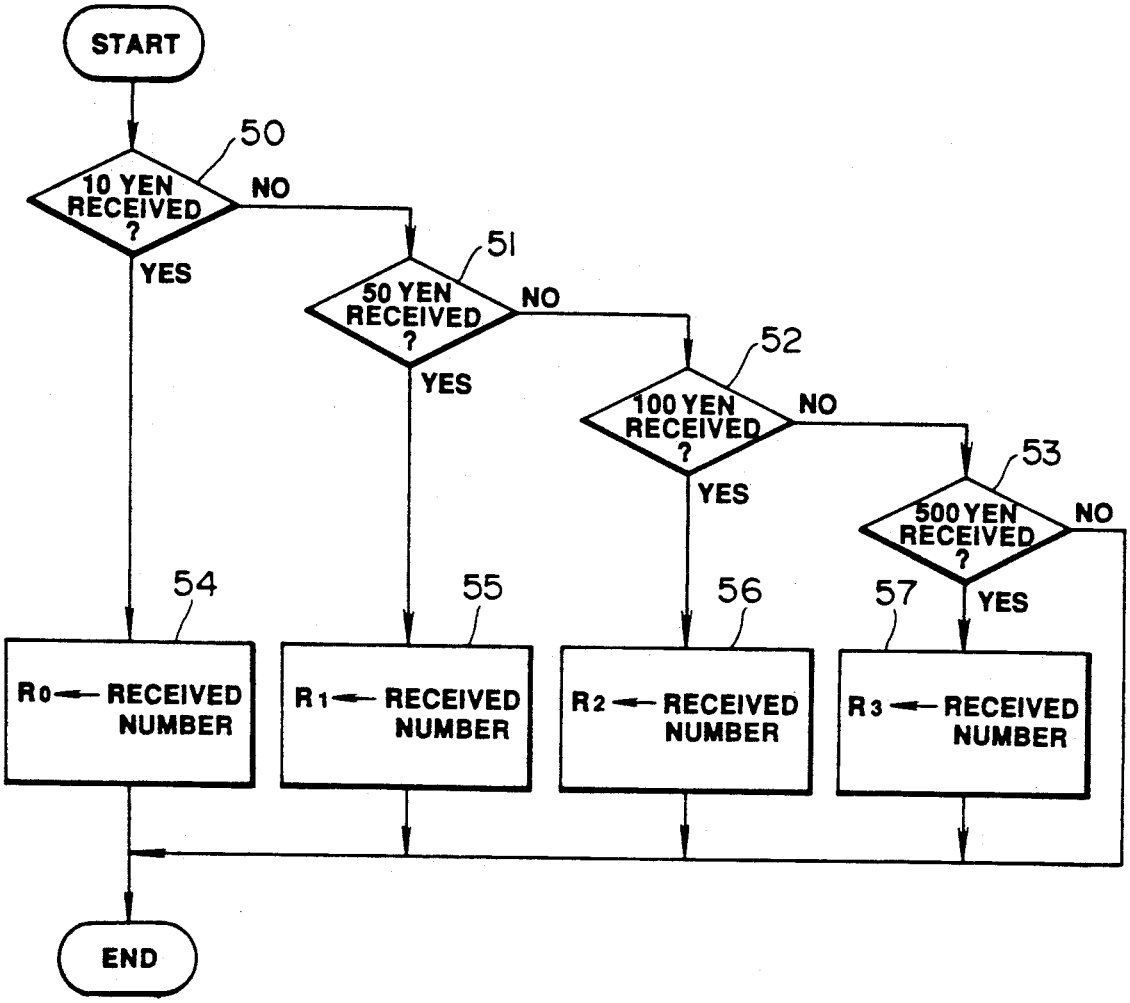
FIG. 5 is a flowchart illustrating details of a money-denominationally processing of FIG. 4.
Figure 6:
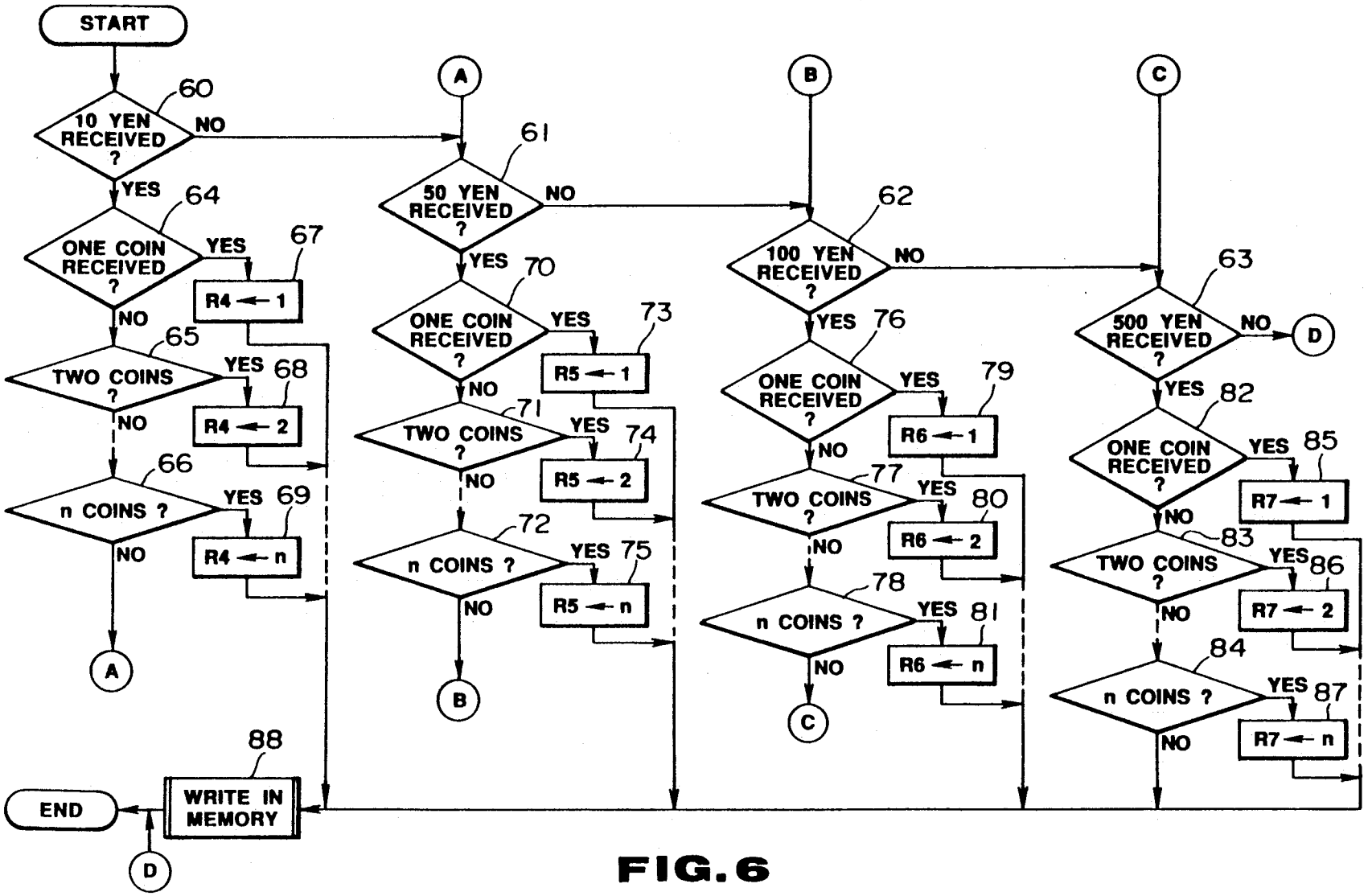
FIG. 6 is a flowchart illustrating details of selections of classification accuracies of FIG. 4.

FIG. 4 is a flowchart of a main procedure of classifying coins and setting corresponding classification accuracies. FIG. 5 is a flowchart of processings according to the separate denominations of the classification accuracy set procedure. FIG. 6 is a flowchart of a classification accuracy selection procedure.

Hereinafter, the operation of the embodiment of FIG. 1 will be described with reference to these flowcharts.

Once the apparatus starts, a predetermined initialization is performed ( step 40 ) and then the reference values Hl to Hn, Il to In, Jl to Jn and Kl to Kn of the classification accuracies and the indexes LH, LI, LJ and LK are written into CPU 10 from the memory blocks MB1 and MB2 of the memory 9 ( step 41 ).

In this state, when the classification accuracy selection mode is not instructed and dropping coins 5 into the slot 13 starts, CPU 10 executes the same classification processing as a prior art processing ( step 43 ). That is, CPU 10 compares a voltage signal determined by the determiner 6 with a reference value designated by each of the indexes LH, LI, LJ and LK of the reference values for each denomination, and determines whether the received coins are true coins or not and also which denominations the received coins have. The movable elements 15 and 16 are operated in accordance with the determination result so as to guide the received coins into the false coin passageway, or a change tube or a cashbox of an appropriate denomination. Concurrently, CPU 10 causes the display 11 to display a sum of the received coins.

On the other hand, once a supervisor etc. approaches the magnet 8 to the reed switch 7 to turn the reed switch 7 on, CPU 10 determines that the classification accuracy selection mode has been instructed ( step 42 ) and executes a classification accuracy set procedure following a step 44. The magnet 8 may be a magnetized tip of a screw driver and the like. In this case, approaching a magnetized tip of a screw driver to the reed switch 7 turns the reed switch 7 on.

In the classification accuracy set procedure, once coins are received ( step 44 ) the denomination of each of the received coins is determined by the money-denominational procedure and the number of the received coins is counted. That is, as shown in detail in FIG. 5, CPU 10 determines whether the denomination of each of the received coins is 10, 50, 100 or 500 yen similarly as in a classification procedure ( steps 50 to 53 ). The number of each of the received coins according to an appropriate denomination is renewed and stored in corresponding one of the register areas R0 to R3 according to the denominations ( steps 54 to 57 ).

In this state, once the magnet 8 is moved away from the reed switch 7, the reed switch 7 is turned off ( step 46 ) and a classification accuracy selection procedure of a next step 47 is executed.

As shown in detail in FIG. 6, in accordance with the classification accuracy selection procedure, whether a change instruction of a classification accuracy for each of 10-, 50-, 100- and 500-yen coins is outputted or not, that is, whether each of 10-, 50-, 100- and 500-yen coins is received or not is checked ( steps 60 to 63 ). When the change instruction has been produced, contents of the register areas R0 to R3 serve to check what a receipt number of coins of a corresponding denomination of money ( steps 64 to 66, 70 to 72, 76 to 78 and 82 to 84 ) has been, so that the indexes of the denominations LH to LK are renewed in response to the receipt number ( steps 67 to 69, 73 to 75, 79 to 81, and 85 to 87 ).

Thus, the indexes LH to LK of the register areas R4 to R7 are rewritten in response to the receipt number of coins of the corresponding denomination of money.

When CPU 10 has completed the procedure of the step 47, CPU 10 checks whether or not the reference values of the classification accuracies have been changed. When the reference values of the classification accuracies have been changed, CPU 10 again reads the reference values and the indexes of each of the demonimations out of the memory blocks MB1 and MB2 of the memory 9 and waits for a next classification process.

Thus, when a two-rating severer reference value is desired to be set in the state that, for example, the loosest reference value H1 out of the classification accuracies for 10-yen coin has been employed, the reed switch 7 is turned on, the operation of the apparatus is changed over into the classification accuracy selection mode, and then 3 10-yen coins are dropped, so that the index LH is rewritten from 1 to 3 and after this time, the reference value H3 designated by the equation Lh=3 serves to classify 10-yen coins. This procedure is applicable similarly to 50-, 100- and 500-yen coins.

Thus, the present embodiment can very easily make the classification accuracies strict or loose.

In accordance with the above embodiment, the magnet 8 is approached to the reed switch 7 in order to select the classification accuracy selection mode, however, a keyswitch and the like may be alternatively used in order to select the classification accuracy selection mode.

Alternatively, a specified sum of money may be previously caused to correspond to a predetermined identification number, so that the operation of the apparatus is changed over into the classification accuracy selection mode when the specified sum of money is received and the classification accuracy for each denomination is changed over in response to a subsequent receipt number of coins of a corresponding denomination.

While the above embodiment rewrites the indexes LH to LK in response to the receipt numbers of coins, a single reference value may be alternatively determined for each denomination and a predetermined value may be added to or detracted from this reference value in response to the receipt number of coins of a corresponding denomination.

While the above embodiment rewrites the classification accuracies for 10-yen coin in response to a total receipt number of 10-yen coins, one 10-yen coin may be alternatively first dropped so as to instruct to start changing the classification accuracies for 10-yen coin and then the classification accuracies may be actually changed in response to the total sum of subsequently received coins.

In addition, while the above embodiment rewrites the classification accuracies for 10-yen coin in response to the receipt number of 10-yen coins, a special gauge coin corresponding to 10-yen coin may be used to rewrite these classification accuracies.

What is claimed is:

1. A classification accuracy setting device of a coin selector in which coin identification means provided in a coin passageway produces a signal corresponding to a property of a received coin and which compares the signal with a reference value corresponding to a predetermined classification accuracy and classifies the received coin in accordance with a denomination of the received coin, said classification accuracy setting device of the coin selector comprising:

mode changeover means for changing over the coin selector into a classification accuracy selection mode;

memory means for storing reference values corresponding to the predetermined classification accuracy for each denomination of coins;

counting means for counting the number of coins of each denomination received in the classification accuracy selection mode;

rewriting means for rewriting each reference value for each of the denominations stored in the memory means in accordance with the receipt number of each denomination detected by the counting means, said memory means comprises:

a first memory area for storing a plurality of reference values for each of the denominations corresponding to indexes each indicating a reference value to be applied; and a second memory area for storing the number of the received coins for each of the denominations and said indexes indicating reference values for each of the denominations.

2. A classification accuracy setting device of a coin selector of claim 1, wherein said mode changeover means has a reed switch operating on approach of a magnet.

3. A classification accuracy setting device of a coin selector of claim 1, wherein said memory means comprises an EEROM.

4. A classification accuracy setting device of a coin selector of claim 1, wherein said rewriting means rewrites only the reference value corresponding to a denomination of a coin which has been received.

5. A classification accuracy setting device of a coin selector of claim 1, wherein said coin identification means includes:

an oscillating coil excited by a signal of a predetermined frequency and provided at one side of the coin passageway; and a receiving coil provided at the other side of the coin passageway and coupled with the oscillating coil, the receiving coil producing a voltage signal corresponding to the property of the received coin.

6. A classification accuracy setting device of a coin selector in which coin identification means provided in a coin passageway produces a signal corresponding to a property of a received coin and which compares the signal with a reference value corresponding to a predetermined classification accuracy and classifies the received coin in accordance with a denomination of the received coin, said classification accuracy setting device of the coin selector comprising:

mode changeover means for changing over the coin selector into a classification accuracy selection mode;

memory means for storing reference values corresponding to the predetermined classification accuracy for each denomination of coins;

counting means for counting the number of coins of each denomination received in the classification accuracy selection mode;

rewriting means for rewriting each reference value for each of the denominations stored in the memory means in accordance with the receipt number of each denomination detected by the counting means, said memory means comprises:

a first memory area for storing a plurality of reference values for each of the denominations corresponding to indexes each indicating a reference value to be applied;

a second memory area for storing the number of the received coins for each of the denominations and said indexes indicating reference values for each of the denominations, and said rewriting means rewrites the receipt number of coins and the indexes for each of the denominations stored in the second memory area of the memory means.

7. A classification accuracy setting device of a coin selector in which coin identification means provided in a coin passageway produces a signal corresponding to a property of a received coin and which compares the signal with a reference value corresponding to a predetermined classification accuracy and classifies the received coin in accordance with a denomination of the received coin, said classification accuracy setting device comprising:

a first memory for storing a plurality of reference values for each of denominations corresponding to indexes each indicating a reference value to be applied;

a second memory for storing the number of received coins for each of the denominations and the indexes indicating the reference values for each of the denominations;

mode changeover means for changing over the coin selector into a classification accuracy selection mode;

counting means for counting the number of coins of each of the denominations received in the classification accuracy selection mode; and rewriting means for rewriting indexes stored in the second memory and indicating the receipt number of each of the denominations and reference values for each of the denominations in accordance with the receipt number of each of the denominations detected by the counting means.

* * * * *